US006062907A

United States Patent [19]

Tan et al.

[11] Patent Number: 6,062,907

[45] Date of Patent: May 16, 2000

[54] OFFSET ULTRA SCSI CONNECTOR

[75] Inventors: Haw-Chan Tan, Diamond Bar; Wayne Huang, Alhambra, both of Calif.

[73] Assignee: Hon Hai Precision Ind. Co., Ltd., Taipei Hsien, Taiwan

[21] Appl. No.: 09/243,971

[22] Filed: Feb. 4, 1999

[51] Int. Cl.[7] ..... H01R 13/648

[52] U.S. Cl. ..... 439/610; 439/405; 439/606

[58] Field of Search ..... 439/606, 405, 439/404, 610, 607

[56] References Cited

U.S. PATENT DOCUMENTS

| | | | |
|---|---|---|---|
| 5,518,421 | 5/1996 | Davis | 439/610 |
| 5,766,033 | 6/1998 | Davis | 439/405 |
| 5,820,412 | 10/1998 | Koegel et al. | 439/610 |
| 5,938,476 | 8/1999 | Wu et al. | 439/610 |
| 5,941,733 | 8/1999 | Lai | 439/610 |

*Primary Examiner*—Gary F. Paumen
*Attorney, Agent, or Firm*—Wei Te Chung

[57] ABSTRACT

An offset Ultra SCSI connector comprises a dielectric housing having an island portion, a rear portion, and a plurality of terminals embedded therein. The terminals have insulation displacement sections defining a connecting face on said rear portion and insertion sections on said island portion. A carrier retaining a plurality of conductive wires in traverse slots thereof is assembled to the rear portion. A pair of wedges is formed on opposite ends of the carrier. A first EMI shield is assembled to the housing from a bottom thereof. A pair of retaining tabs upwardly extends from opposite ends of the shield. Each retaining tab defines an opening securely engaged with the corresponding wedge.

3 Claims, 6 Drawing Sheets

OFFSET ULTRA SCSI CONNECTOR

FIELD OF THE INVENTION

The present invention relates to a connector, and more particularly to an offset ultra SCSI connector having an EMI shield.

DESCRIPTION OF PRIOR ART

As the speed of signal transmission through a cable assembly increases, the need to isolate and protect the signals from electrical noise becomes important. One existing method of achieving this is by attaching an EMI shield to a housing of each connector.

EMI shields are typically assembled to walls of the housing. In some applications, such as an offset ultra SCSI connector, the EMI shield is molded with a connector housing by an over-molding process. During the over-molding process, conductive wires may be easily disconnected from corresponding insulation displacement sections due to the flow of molten plastic. Thus, the final product is rendered ineffective.

SUMMARY OF THE INVENTION

An objective of this invention is to provide an EMI shield for an offset ultra SCSI connector wherein the EMI shield is fixedly assembled to a connector housing thereby ensuring effective connection therebetween.

Another objective of this invention is to provide a method for manufacturing an offset ultra SCSI connector having an EMI shield assembled thereto. In order to achieve the objectives set forth, an offset Ultra SCSI connector comprises a dielectric housing having an islandportion, a rear portion and a plurality of terminals embedded therein. The terminals have insulation displacement sections defining a connecting face on the rear portion and insertion sections on the island portion. A carrier retaining conductive wires in traverse slots thereof is assembled to the rear portion for assembling a plurality of conductive wires thereto. A pair of wedges is formed on opposite ends of the carrier. A first EMI shield is assembled to the housing from a bottom thereof. A pair of retaining tabs upwardly extends from opposite ends of the shield. Each retaining tab defines an opening securely engaged with the corresponding wedge.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 1:
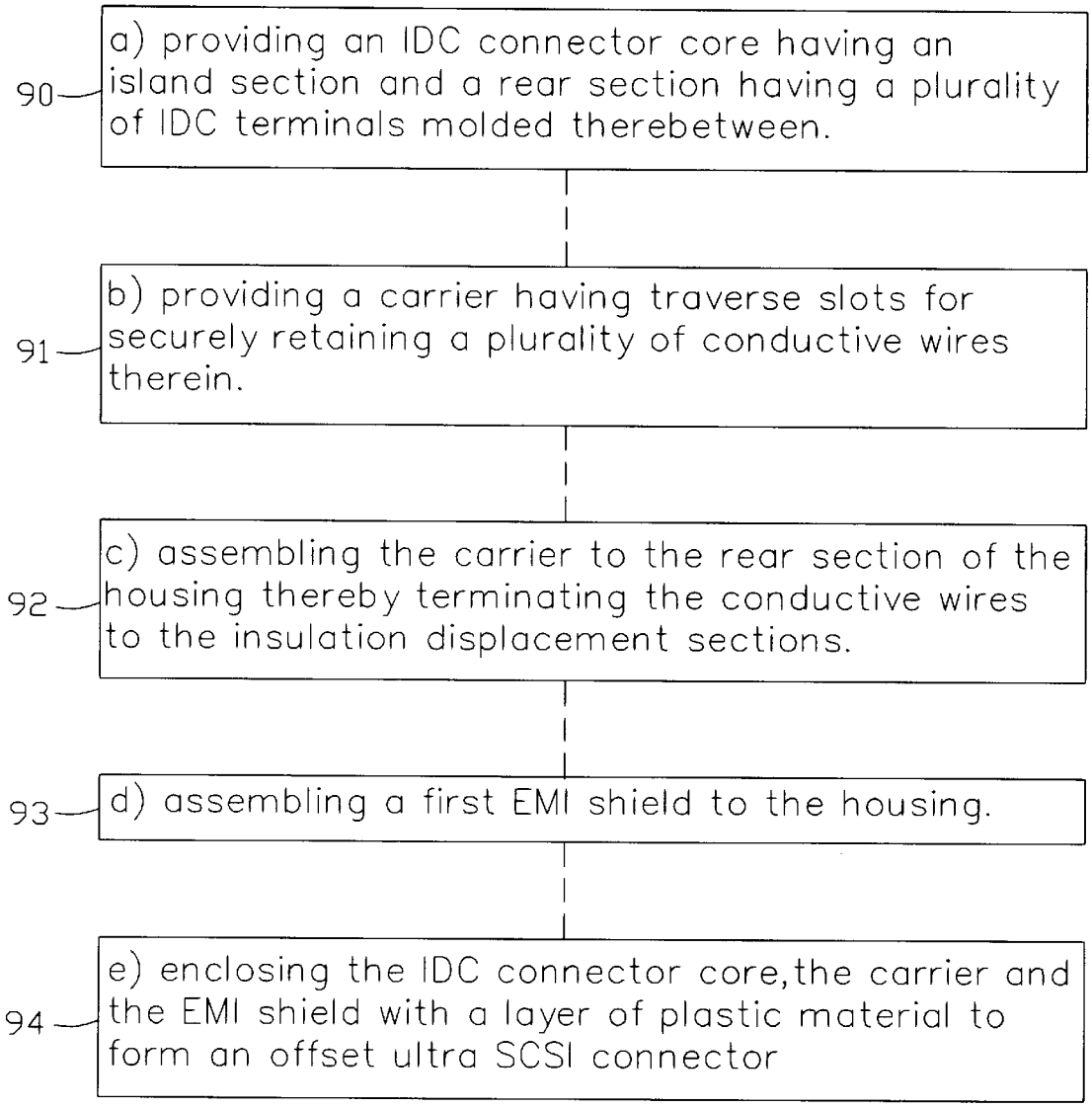
FIG. 1 is a flow chart of a forming process for an offset ultra SCSI connector.

Referring to FIG. 1, a method for forming an offset ultra SCSI connector comprises the following steps. Step 90) providing an IDC connector housing having an island portion and a rear portion. A plurality of IDC terminal is molded between the island and rear portions. Each IDC terminal has a connecting section extending into the island portion and an insulation displacement section extending beyond the rear portion. Step 91) providing a carrier having traverse slots for retaining a plurality of conductive wires therein. Step 92) assembling the carrier to the rear portion of the housing thereby terminating the conductive wires at the insulation displacement sections. Step 93) assembling a first EMI shield to the housing and the associated carrier. Step 94) enclosing the IDC connector housing, the carrier and the EMI shield with a layer of plastic material to form an offset ultra SCSI connector.

According to one aspect of the preferred embodiment, step 91) further includes step 95) forming a pair of wedges on opposite ends of the carrier, and step 93) includes step 96) defining openings on a pair of tabs formed on opposite ends of the first EMI shield. By this arrangement, the EMI shield can be securely attached to the wedges of the carrier. In addition, step 93) includes step 97) assembling a second EMI shield to the first EMI shield.

Figure 2:
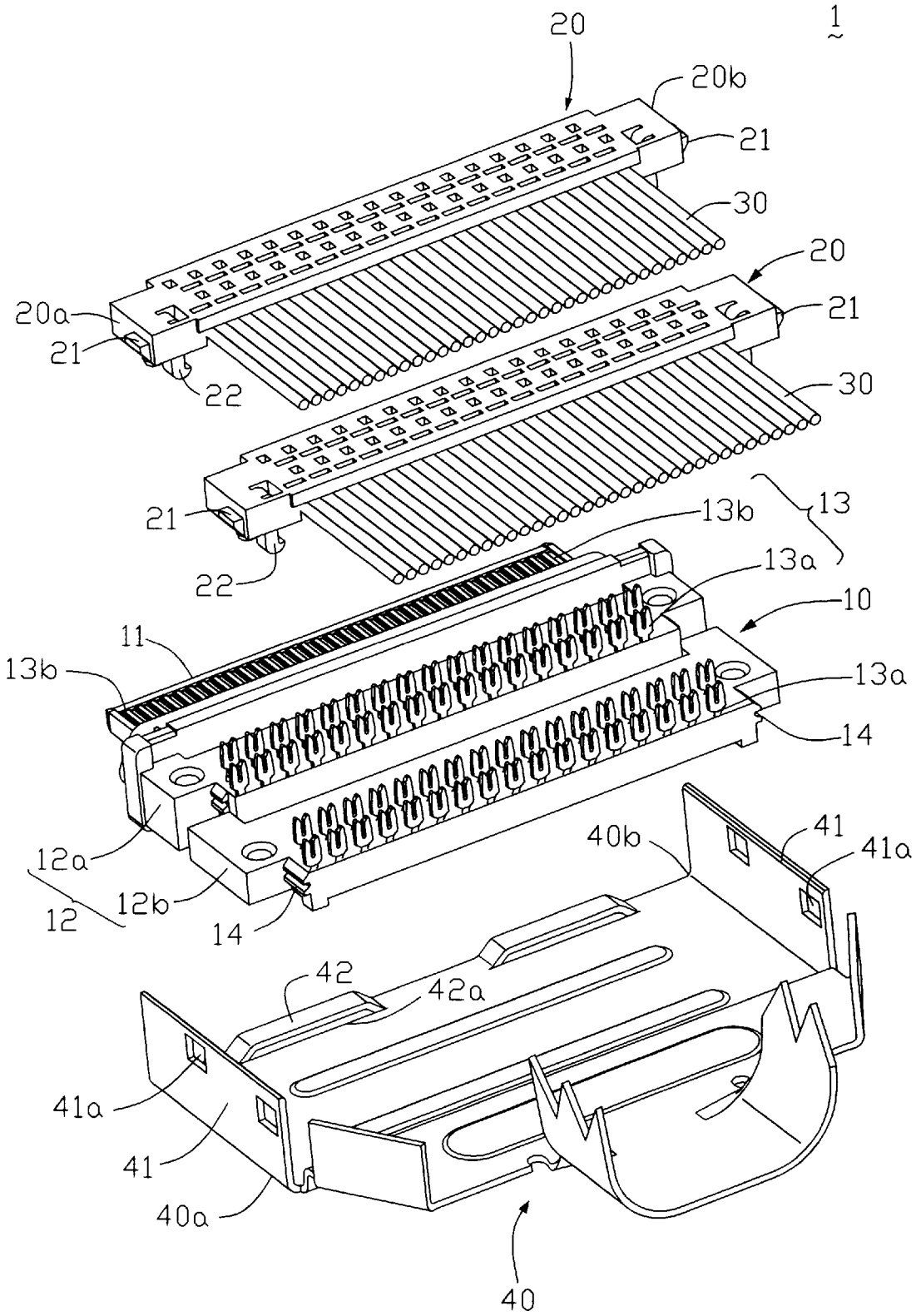
FIG. 2 is an exploded view of the offset ultra SCSI connector in accordance with the present invention before an over-molding process is performed thereon.
Figure 3:
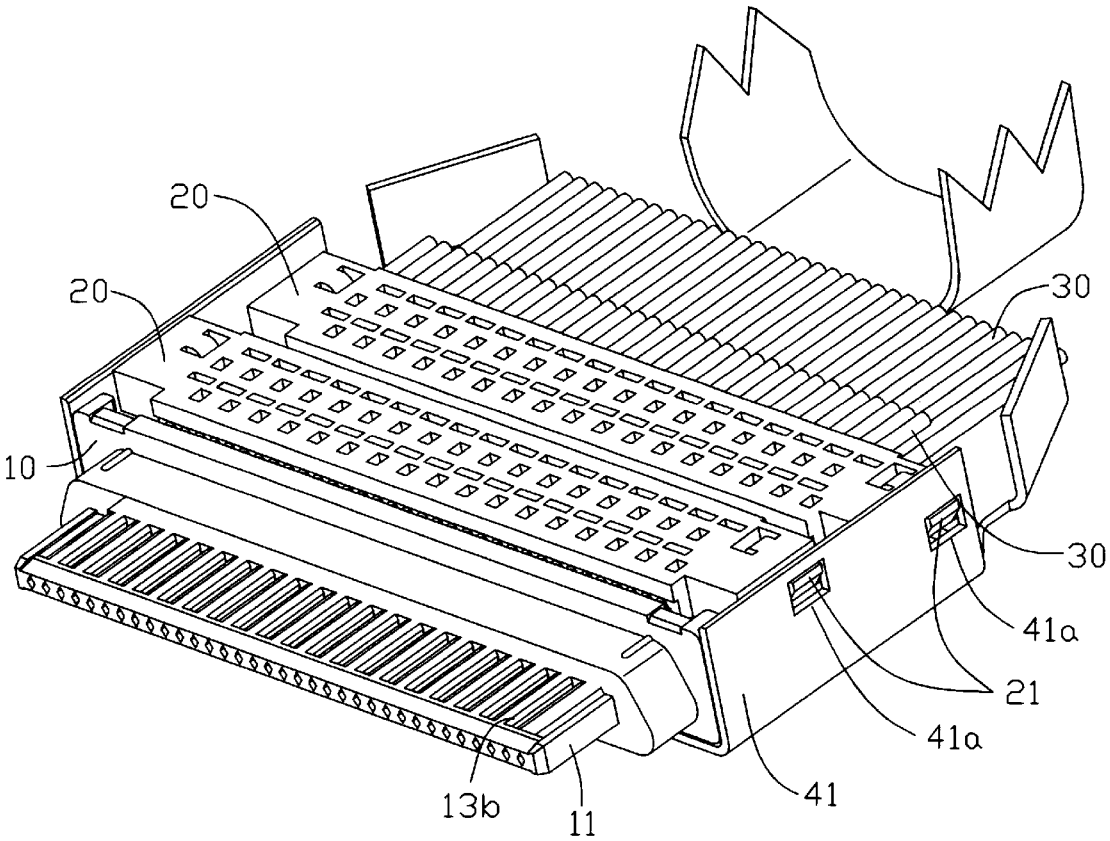
FIG. 3 is an assembled view of FIG. 2.

Referring to FIGS. 2 and 3, an offset ultra SCSI connector 1 in accordance with the present invention comprises a dielectric housing 10 having an island portion 11 and a rear portion 12 having first and second piers 12*a*, 12*b*. A plurality of terminals 13 is embedded between the island portion 11 and the rear portion 12. Each terminal 13 has an insulation displacement section 13*a* projecting beyond the first or second piers 12*a*, 12*b* and a mating section 13*b* disposed within the island portion 11.

A pair of carriers 20 is assembled to the housing 10. Each carrier 20 has a plurality of traverse slots (not shown here but may be referred to the copending application Ser. No. 09/191,366 filed Nov. 13, 1998) for retaining conductive wires 30 therein. When the carrier 20 and the conductive wires 30 are assembled to the housing 10, terminations between the conductive wires 30 and the insulation displacement sections 13*a* are achieved. Each carrier 20 forms a pair of wedges 21 on opposite ends 20*a*, 20*b* thereof. In addition, each carrier 20 includes latches 22 for engaging with corresponding hooks 14 of the housing 10.

A first EMI shield 40 is assembled to the housing 10 from a bottom thereof. The first EMI shield 40 includes a pair of retaining tabs 41 extending from opposite ends 40*a*, 40*b* thereof. Each retaining tab 41 defines a pair of openings 41 a for securely engaging with the corresponding wedges 21 of the carriers 20 when the first EMI shield 40 is assembled to the housing 10. With this double engagement, the carriers 20 are firmly attached to the housing 10 and the EMI shield 40. In addition, the conductive wires 30 are firmly retained within the carriers 20 which in turn are securely attached to the housing 10 and the first EMI shield 40. Thus, disconnection between the conductive wires 30 and the insulation displacement sections 13*a* during an over-molding process is prevented. The first EMI shield 40 further forms a latch 42 defining a passage 42*a* thereunder.

Figure 4:
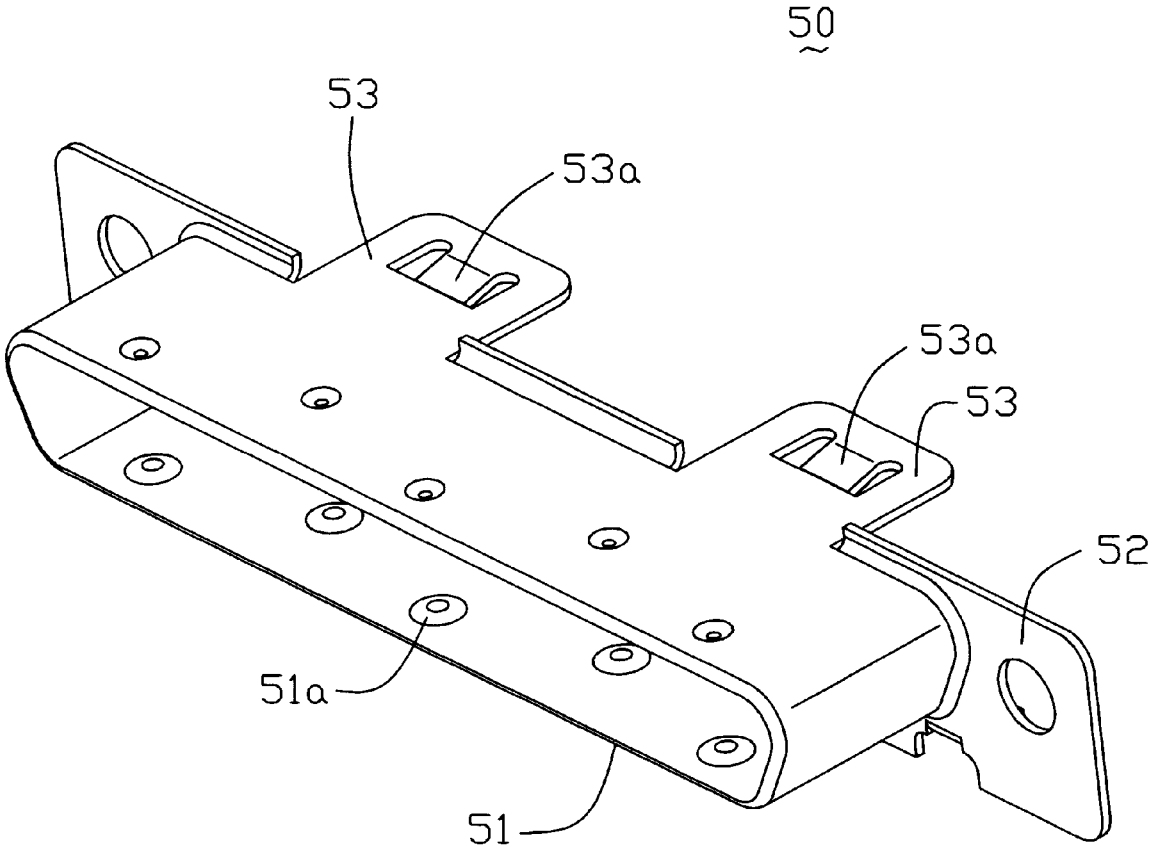
FIG. 4 is a perspective view of a second EMI shield.
Figure 5:
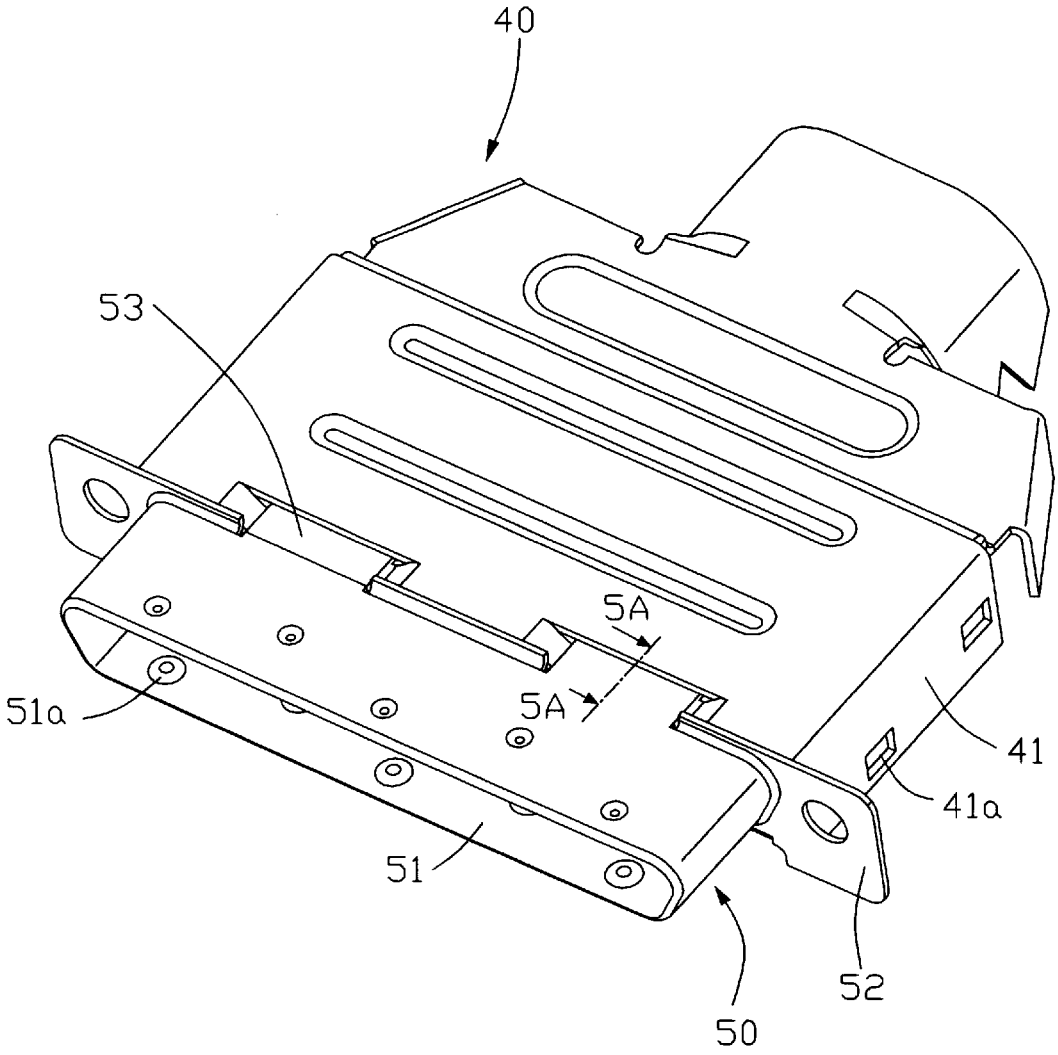
FIG. 5 is an assembled view of first and second EMI shields.
Figure 5A:
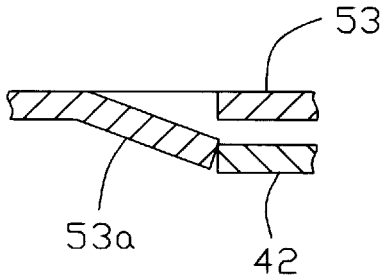
FIG. 5A is a partial, cross sectional view taken from line I—I of FIG. 5 showing engagement between a latch and a connecting tab.

Referring to FIGS. 4, 5 and 5A, a second EMI shield 50 for shielding the island portion 11 is attached to the first EMI shield 40. The second EMI shield 50 includes a shroud 51 and a flange 52. The shroud 51 forms a plurality of dimples 51*a* for electrically engaging with a complementary EMI shield (not shown). A pair of connecting tabs 53 extends from the flange section 52. Each tab 53 forms a ratchet 53*a* extending toward the flange section 52. The connecting tabs 53 extend through the passages 42*a* under the latches 42 of the first EMI shield 40. During insertion, the ratchet 53*a* is deformed and resumes to its original shape after a tip of the ratchet 53*a* passes through the latches 42 (best seen in FIG. 5A). By this arrangement, the second EMI shield 50 is firmly attached to the first EMI shield 40.

Figure 6:
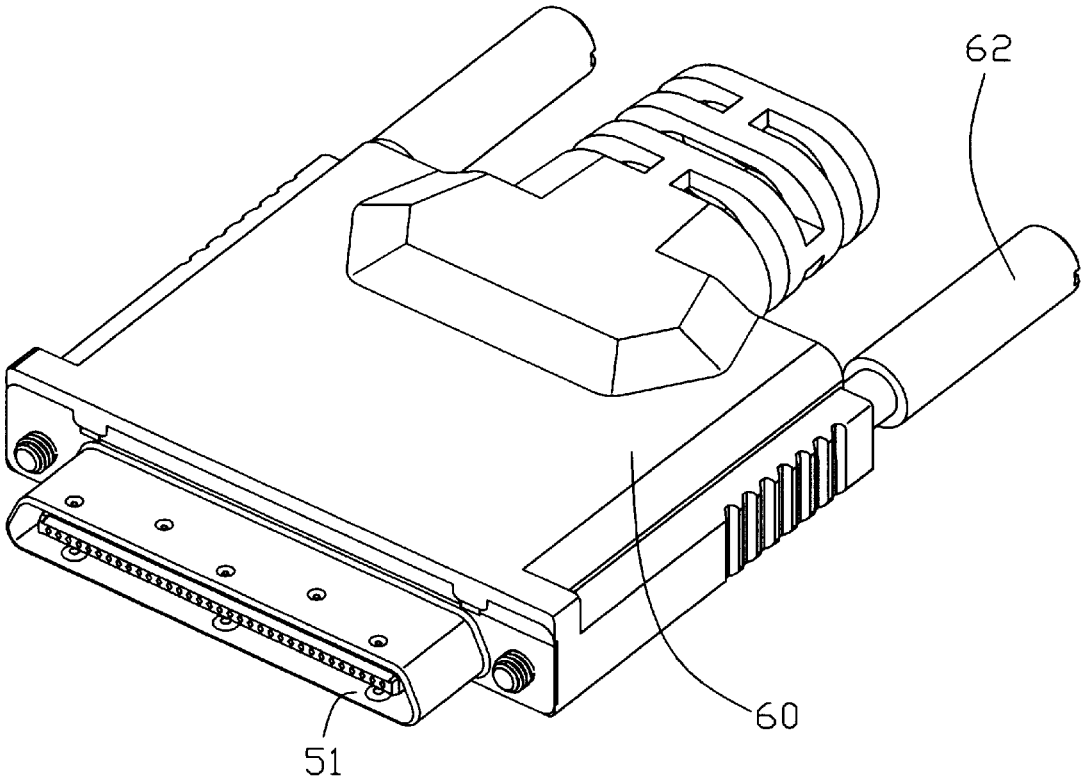
FIG. 6 is a perspective view of the fully assembled offset ultra SCSI connector after an over-molding process is performed thereon.

As shown in FIG. 6, the first EMI shield 40, the housing 10 and the conductive wires 30 are all enclosed in a layer of plastic after an over-molding process is performed thereon. In addition, a pair of locking bolts 62 is assembled to the connector 1 for engaging with complementary nuts (not shown).

It is noted that the rear portion 12 of the connector housing 10 for terminating the conductive wires 30 thereon, is positioned within the shield 40, and is secured to the corresponding carriers 20 under the condition that such carriers 20 are secured to the shield 40, respectively, so the connector housing 10 may be securely retained within the shield 40. Understandably, the carriers 20 is secured to the shield 40 and combined with the connector housing 10, thus cooperating with the shield 40 to sandwich the rear portion 12 of the connector housing 10 therebetween and also cooperating with the connector housing 10 to sandwich the conductive wires 30 therebetween. Accordingly, the engagement between the conductive wires 30 and the corresponding insulation displacement sections 13*a* of the terminals 13 is guaranteed during the over-molding process.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An offset Ultra SCSI connector comprising:

a dielectric housing having an island portion, a rear portion, and a plurality of terminals embedded therein, said terminals having insulation displacement sections defining a connecting face on said rear portion and insertion sections on said island portion;

a carrier for assembling a plurality of conductive wires to said connecting face, said carrier having a plurality of traverse slots for retaining said conductive wires therein, a pair of wedges formed on opposite ends of said carrier; and a first EMI shield assembled to said housing from a bottom thereof, a pair of retaining tabs upwardly extending from opposite ends thereof, each retaining tab defining an opening securely engaged the said corresponding wedge;

wherein said first EMI shield includes a strain relief at a rear end thereof;

wherein said strain relief is a clamp;

further comprising a second EMI shield assembled to said housing, said second EMI shield including a shroud enclosing said island portion and a flange securely engaged with said first EMI shield.

2. A method for forming an offset ultra SCSI connector; comprising the steps of:

a) providing an IDC connector housing having an island portion and a rear portion, a plurality of IDC terminals molded between said island and rear portions, each IDC terminal having a connecting section extending into said island portion and an insulation displacement section extending beyond said rear portion;

b) providing a carrier having traverse slots for retaining a plurality of conductive wires therein;

c) assembling said carrier to said rear portion thereby terminating said conductive wires at said insulation displacement sections;

d) assembling a first EMI shield to said housing and said carrier; and e) enclosing said IDC connector housing, said carrier and said first EMI shield with a layer of plastic material to form an offset ultra SCSI connector.

wherein step b) further includes step f) forming a pair of wedges on opposite ends of said carrier;

wherein step d) further includes step g) defining openings on a pair of tabs formed on opposite ends of said first EMI shield, said openings receiving corresponding ones of said wedges;

wherein step d) includes step h_assembling a second EMI shield to said first EMI shield.

3. A connector assembly comprising:

a dielectric housing including a rear portion;

a plurality of terminals positioned within the housing, each of said terminals including an insulation displacement section located on said rear portion;

at least a carrier secured to the rear portion of the housing for sandwiching a plurality of conductive wires therebetween;

a metal shield receiving the rear portion of the housing therein; and means for combining the shield with one of said carrier and said housing;

wherein said means includes at least a wedge on the carrier and at least a retaining tab on the shield which receives the wedge therein.

* * * * *